US011580824B2

(12) United States Patent
Savin

(10) Patent No.: US 11,580,824 B2
(45) Date of Patent: Feb. 14, 2023

(54) MULTI-SPORT CHALLENGE SYSTEMS AND METHODS

(71) Applicant: West Flagler Associates, Ltd., Miami, FL (US)

(72) Inventor: Scott Savin, Miami, FL (US)

(73) Assignee: WEST FLAGLER ASSOCIATES, LTD., Miami, FL (US)

( * ) Notice: Subject to any disclaimer, the term of this patent is extended or adjusted under 35 U.S.C. 154(b) by 0 days.

(21) Appl. No.: 17/215,637

(22) Filed: Mar. 29, 2021

(65) Prior Publication Data

US 2022/0309883 A1 Sep. 29, 2022

(51) Int. Cl.
*G07F 17/38* (2006.01)
*G07F 17/32* (2006.01)

(52) U.S. Cl.
CPC ..... *G07F 17/38* (2013.01); *G07F 17/3262* (2013.01); *G07F 17/3295* (2013.01)

(58) Field of Classification Search
CPC ..... G07F 17/38; G07F 17/3262; G07F 17/3288; G07F 17/3276; G07F 17/323; G07F 17/3234; G07F 17/3295; G07F 17/3237; G06Q 30/0209; G06Q 50/34; A63C 19/08; A63C 2019/085; E04H 3/12; E04H 3/14
See application file for complete search history.

(56) References Cited

U.S. PATENT DOCUMENTS 3,310,312 A * 3/1967 Peeples ..... A63B 57/405 124/81
4,074,905 A * 2/1978 High ..... A63B 47/025 473/421
4,357,659 A * 11/1982 Nathans ..... G06Q 50/34 463/47
4,915,384 A * 4/1990 Bear ..... A63B 69/3614 473/154
4,941,662 A * 7/1990 DePerna ..... E04H 3/14 273/317.6
5,083,271 A * 1/1992 Thacher ..... A63F 13/46 700/92
5,359,510 A * 10/1994 Sabaliauskas ..... A63F 13/12 273/DIG. 26

(Continued)

*Primary Examiner* — David L Lewis
*Assistant Examiner* — Matthew D Hoel
(74) *Attorney, Agent, or Firm* — Akerman LLP

(57) ABSTRACT

A multi-sport challenge system may include a multi-sport facility, a sport challenge menu including a plurality of selectable sport challenges, and a fee/prize subsystem. The multi-sport facility may include a plurality of sport grounds, wherein each of the sport grounds includes a full, partial, or simulated sport grounds. The sport challenge menu may include an entry fee and financial prize corresponding to each selectable sport challenge of the menu, wherein the entry fee is to be paid by a participant that selects the corresponding sport challenge for an opportunity to attempt the sport challenge. The financial prize may be awarded to the participant if the attempt successfully completes the sport challenge. The fee/prize subsystem may be configured to receive sport challenge selections made by participants and to collect the corresponding entry fees from the participants and output corresponding financial prizes upon successful completion of the selected sport challenges.

13 Claims, 5 Drawing Sheets

130

| Entry Fee | Sport Challenge | Financial Prize |
|---|---|---|
| $10 | Hole in one | $2500 |
| $10 | Bowl three strikes | $250 |
| $10 | Kick 35 yard field goal | $500 |
| $10 | Hit target at home plate from center field | $500 |
| $10 | Make half-court basketball shot | $200 |

(56) References Cited

U.S. PATENT DOCUMENTS 5,359,986 A * 11/1994 Magrath, III ..... A63B 69/406 124/78
5,401,018 A * 3/1995 Kelly ..... A63B 63/00 473/421
5,443,260 A * 8/1995 Stewart ..... A63B 69/0002 473/421
5,485,994 A * 1/1996 Underwood ..... A63B 63/00 473/451
5,733,209 A * 3/1998 McIntyre, IV ..... A63B 69/409 473/133
5,855,516 A * 1/1999 Eiba ..... G07F 17/3276 700/91
5,873,782 A * 2/1999 Hall ..... G07F 17/3288 700/91
5,882,204 A * 3/1999 Iannazo ..... A63B 24/0021 473/422
5,897,438 A * 4/1999 Kunz ..... A63C 19/10 52/287.1
5,917,725 A * 6/1999 Thacher ..... G07F 7/025 463/40
6,004,211 A * 12/1999 Brenner ..... G07F 17/32 463/40
6,082,887 A * 7/2000 Feuer ..... A63F 3/081 700/91
6,089,981 A * 7/2000 Brenner ..... G06Q 50/34 463/40
6,099,409 A * 8/2000 Brenner ..... G07F 17/32 463/40
6,174,237 B1 * 1/2001 Stephenson ..... A63F 13/12 463/40
6,287,202 B1 * 9/2001 Pascal ..... A63F 13/12 463/25
6,371,855 B1 * 4/2002 Gavriloff ..... A63F 13/65 463/9
6,425,828 B2 * 7/2002 Walker ..... G07F 17/32 700/92
6,443,838 B1 * 9/2002 Jaimet ..... G06Q 50/34 463/16
6,656,042 B2 * 12/2003 Reiss ..... G07F 17/3288 463/16
6,669,565 B2 * 12/2003 Liegey ..... G07F 17/3288 463/9
6,780,103 B2 * 8/2004 Bansemer ..... G07F 17/3295 463/7
6,811,482 B2 * 11/2004 Letovsky ..... G07F 17/3295 463/20
6,813,526 B1 * 11/2004 Dodd, Jr. ..... G05B 19/0423 700/65
6,817,948 B2 * 11/2004 Pascal ..... G07F 17/3211 463/25
6,955,611 B2 * 10/2005 Kimmel ..... A63B 67/02 273/144 R
7,066,845 B2 * 6/2006 Joseph ..... A63B 69/0071 124/78
7,094,154 B2 * 8/2006 Kellerman ..... G07F 17/3244 463/25
7,118,498 B2 * 10/2006 Meadows ..... A63B 71/0669 473/407
7,175,524 B2 * 2/2007 Bansemer ..... G07F 17/3262 463/16
7,192,352 B2 * 3/2007 Walker ..... G07F 17/3276 463/9
7,364,509 B2 * 4/2008 Slade ..... G06Q 10/10 463/43
7,548,242 B1 * 6/2009 Hughes ..... G07F 17/3288 463/31
7,614,944 B1 * 11/2009 Hughes ..... A63F 13/85 463/4
7,637,809 B2 * 12/2009 Ghosh ..... G06Q 30/0238 700/91
7,684,874 B2 * 3/2010 Schlottmann ..... G07F 17/3211 463/9
7,684,882 B2 * 3/2010 Baerlocher ..... G07F 17/3211 463/16
7,689,302 B2 * 3/2010 Schlottmann ..... G07F 17/3276 463/9
7,691,009 B2 * 4/2010 Savarese ..... G06K 19/07758 473/353
7,736,249 B2 * 6/2010 Zhang ..... F41B 11/52 124/78
7,766,766 B2 * 8/2010 Savarese ..... H01Q 1/2225 473/351
7,787,972 B2 * 8/2010 Schlottmann ..... G07F 17/323 463/16
7,791,607 B1 * 9/2010 Hughes ..... G07F 17/326 463/31
7,824,267 B2 * 11/2010 Cannon ..... G07F 17/34 463/16
7,846,015 B2 * 12/2010 Bansemer ..... G07F 17/3262 463/16
7,850,523 B2 * 12/2010 Ghosh ..... G06Q 30/0238 700/91
7,872,655 B2 * 1/2011 Hughes ..... A63F 13/537 463/31
7,922,586 B2 * 4/2011 Heckendorf, III ... A63B 69/002 463/42
7,934,983 B1 * 5/2011 Eisner ..... A63K 3/00 463/6
7,985,132 B2 * 7/2011 Walker ..... G07F 17/3276 700/91
8,002,645 B2 * 8/2011 Savarese ..... A63B 43/00 473/353
8,105,166 B2 * 1/2012 Cayce ..... G07F 17/3272 463/40
8,137,172 B2 * 3/2012 Lydon ..... G09B 7/00 463/40
8,172,702 B2 * 5/2012 Meadows ..... G06Q 50/10 473/407
8,200,348 B2 * 6/2012 Mazurik ..... G07F 17/32 700/91
8,202,165 B2 * 6/2012 Duhamel ..... G07F 17/32 463/16
8,221,269 B2 * 7/2012 Meadows ..... A63B 71/0669 473/407
8,223,154 B2 * 7/2012 Hughes ..... A63F 13/35 345/475
8,226,495 B2 * 7/2012 Savarese ..... G08B 21/24 473/222
8,292,729 B2 * 10/2012 Vlazny ..... G07F 17/32 700/91
8,313,363 B2 * 11/2012 Maul ..... G06Q 10/00 463/16
8,317,620 B2 * 11/2012 Kelly ..... G07F 17/3267 463/16
8,333,643 B2 * 12/2012 Eisner ..... G06F 17/40 463/6
8,425,350 B2 * 4/2013 Savarese ..... A63B 37/0003 473/353
8,430,733 B2 * 4/2013 Chang ..... G07F 17/32 463/11
8,460,078 B2 * 6/2013 Moore ..... A63F 13/65 463/40
8,460,079 B2 * 6/2013 Smith ..... G07F 17/3288 463/16
8,465,376 B2 * 6/2013 Bentley ..... A63B 60/46 473/221
8,512,162 B2 * 8/2013 Kim ..... A63B 24/0021 473/221
8,523,711 B2 * 9/2013 Meadows ..... A63B 69/36 473/407
8,538,563 B1 * 9/2013 Barber ..... G07F 17/3276 463/28
8,556,752 B2 * 10/2013 Meadows ..... G01S 19/19 473/407
8,585,477 B2 * 11/2013 Cho ..... A63B 71/0622 463/3
8,613,676 B2 * 12/2013 Bentley ..... A63B 21/4035 473/221

(56) References Cited

U.S. PATENT DOCUMENTS 8,620,463 B2 * 12/2013 Doherty ..... A63B 71/0669 700/91
8,624,738 B2 * 1/2014 Savarese ..... A63B 71/0669 340/568.6
8,641,546 B2 * 2/2014 Rauchholz ..... A63B 53/02 473/221
8,641,547 B2 * 2/2014 Rauchholz ..... A63B 69/3617 473/221
8,641,548 B2 * 2/2014 Rauchholz ..... A63B 60/42 473/238
8,678,892 B2 * 3/2014 Ok ..... A63B 69/3658 463/3
8,700,354 B1 * 4/2014 Bentley ..... A42B 3/046 702/141
8,702,516 B2 * 4/2014 Bentley ..... G06K 9/00342 463/39
8,758,166 B2 * 6/2014 Savarese ..... A63B 43/00 473/353
8,761,913 B2 * 6/2014 Mazurik ..... G07F 17/32 700/91
8,790,170 B2 * 7/2014 Arnone ..... G07F 17/3225 273/108
8,805,558 B1 * 8/2014 Daniel ..... A63F 13/46 700/92
8,814,647 B2 * 8/2014 Palmer ..... G07F 17/3295 463/2
8,814,700 B2 * 8/2014 Vlazny ..... G07F 17/3288 463/28
8,827,824 B2 * 9/2014 Bentley ..... A63B 69/36 473/199
8,876,607 B2 * 11/2014 Ng ..... G07F 17/3237 700/91
8,876,619 B2 * 11/2014 Lee ..... A63B 69/3623 473/195
8,882,613 B2 * 11/2014 Zuger ..... G04G 21/00 473/459
8,897,903 B2 * 11/2014 Eisner ..... A63K 3/00 700/91
8,903,521 B2 * 12/2014 Goree ..... A61B 5/1123 700/90
8,905,855 B2 * 12/2014 Fitzpatrick ..... G06T 13/40 473/199
8,913,134 B2 * 12/2014 Goree ..... G01P 15/02 348/157
8,926,443 B2 * 1/2015 Woo ..... A63B 24/0021 473/156
8,934,995 B2 * 1/2015 Eisner ..... A63K 3/00 700/91
8,941,723 B2 * 1/2015 Bentley ..... A63B 69/36 348/47
8,944,899 B2 * 2/2015 Arnone ..... G07F 17/3227 273/108
8,944,928 B2 * 2/2015 Kaps ..... G06T 13/40 473/199
8,994,826 B2 * 3/2015 Bentley ..... G01S 19/19 348/157
9,004,996 B2 * 4/2015 Murakami ..... G07F 17/3297 463/3
9,005,047 B2 * 4/2015 Savarese ..... A63B 71/0605 473/283
9,028,337 B2 * 5/2015 Bentley ..... A63C 5/06 473/223
9,033,810 B2 * 5/2015 Bentley ..... A63B 53/14 473/221
9,039,527 B2 * 5/2015 Bentley ..... G06T 19/006 463/31
9,052,201 B2 * 6/2015 Bentley ..... G01C 25/005
9,076,041 B2 * 7/2015 Bentley ..... A63F 13/00
9,138,638 B2 * 9/2015 Bastawros ..... G06Q 50/265
9,199,177 B2 * 12/2015 Knapp ..... A63F 13/00
9,235,765 B2 * 1/2016 Bentley ..... H04N 7/181
9,247,212 B2 * 1/2016 Bose ..... G06Q 10/0833
9,261,526 B2 * 2/2016 Bentley ..... G01P 13/00
9,286,747 B2 * 3/2016 Chang ..... G07F 17/3295
9,320,957 B2 * 4/2016 Bentley ..... G01D 21/00
9,349,049 B2 * 5/2016 Bentley ..... A61B 5/112
9,361,522 B2 * 6/2016 Bentley ..... G11B 31/006
9,375,624 B2 * 6/2016 Boyd ..... A63B 69/3632
9,393,478 B2 * 7/2016 Niegowski ..... A43B 5/16
9,396,385 B2 * 7/2016 Bentley ..... G06K 9/00711
9,399,162 B2 * 7/2016 Lee ..... A63B 69/36
9,401,178 B2 * 7/2016 Bentley ..... G06K 9/00342
9,406,336 B2 * 8/2016 Bose ..... A63F 13/828
9,409,073 B2 * 8/2016 Boyd ..... G09B 19/0038
9,409,076 B2 * 8/2016 Boyd ..... A63B 60/00
9,418,705 B2 * 8/2016 Kaps ..... G06K 9/00342
9,427,639 B2 * 8/2016 Rauchholz ..... A63B 69/3617
9,433,844 B2 * 9/2016 Boyd ..... A63B 53/04
9,433,845 B2 * 9/2016 Boyd ..... G09B 19/0038
9,440,134 B2 * 9/2016 Nicora ..... A63B 69/36
9,446,294 B2 * 9/2016 Oldknow ..... A63B 69/3685
9,468,855 B2 * 10/2016 Carlberg ..... G06Q 10/10
9,486,669 B2 * 11/2016 Niegowski ..... A63B 24/0003
9,486,694 B2 * 11/2016 Bastawros ..... H04N 5/23296
9,555,307 B1 * 1/2017 Lewis ..... A63B 65/12
9,592,424 B2 * 3/2017 Savarese ..... A63B 37/0003
9,597,570 B2 * 3/2017 Altshuler ..... G09B 19/0038
9,604,142 B2 * 3/2017 Bentley ..... A63F 13/573
9,607,652 B2 * 3/2017 Bose ..... G06K 9/00342
9,610,480 B2 * 4/2017 Boggs ..... A63B 60/52
9,616,299 B2 * 4/2017 Boggs ..... A63B 53/0466
9,619,891 B2 * 4/2017 Bose ..... A63F 13/211
9,622,361 B2 * 4/2017 Bentley ..... H05K 5/0204
9,623,284 B2 * 4/2017 Lafortune ..... A63B 71/146
9,626,554 B2 * 4/2017 Bose ..... A63F 13/65
9,633,254 B2 * 4/2017 Bose ..... A63F 13/213
9,640,032 B2 * 5/2017 Arnone ..... G07F 17/3244
9,643,049 B2 * 5/2017 Bentley ..... A63C 11/00
9,643,064 B2 * 5/2017 Boggs ..... A63B 53/0466
9,646,199 B2 * 5/2017 Bose ..... G11B 27/022
9,646,209 B2 * 5/2017 Kaps ..... G11B 27/031
9,656,134 B2 * 5/2017 Meadows ..... G06F 16/9537
9,661,894 B2 * 5/2017 Niegowski ..... A63B 24/0003
9,662,551 B2 * 5/2017 Akiyama ..... A63B 53/0466
9,694,267 B1 * 7/2017 Thornbrue ..... G06K 9/00342
9,704,350 B1 * 7/2017 Rigopulos ..... G07F 17/326
9,746,354 B2 * 8/2017 Martin ..... H01Q 13/10
9,757,639 B2 * 9/2017 Eisner ..... A63K 3/00
9,764,213 B2 * 9/2017 Nicora ..... A63B 24/0062
9,776,050 B2 * 10/2017 Boggs ..... A63B 53/04
9,789,371 B2 * 10/2017 Boggs ..... A63B 60/00
9,814,935 B2 * 11/2017 Bentley ..... A61B 5/6895
9,824,264 B2 * 11/2017 Bose ..... G16H 30/20
9,830,951 B2 * 11/2017 Bose ..... A63B 71/06
9,866,827 B2 * 1/2018 Bose ..... H04N 7/183
9,884,235 B2 * 2/2018 Min ..... A63B 67/06
9,889,346 B2 * 2/2018 Boggs ..... A63B 60/52
9,911,045 B2 * 3/2018 Bose ..... A63F 13/00
9,925,433 B2 * 3/2018 Boggs ..... A63B 71/0622
9,940,508 B2 * 4/2018 Kaps ..... G06K 9/00711
9,975,031 B2 * 5/2018 Bastawros ..... H04N 5/77
9,999,826 B2 * 6/2018 Ro ..... G09B 19/0038
10,055,941 B2 * 8/2018 Luciano, Jr. ..... G07F 17/326
10,063,929 B1 * 8/2018 Barker ..... H04N 21/439
10,074,242 B2 * 9/2018 Arnone ..... G07F 17/3262
10,086,249 B2 * 10/2018 Nicora ..... A63B 24/0062
10,092,812 B2 * 10/2018 Eisner ..... A63B 71/0616
10,099,112 B1 * 10/2018 Johnson ..... A63F 3/00643
10,109,061 B2 * 10/2018 Bose ..... A63F 13/212
10,124,230 B2 * 11/2018 Thornbrue ..... A63B 69/3635
10,133,919 B2 * 11/2018 Bose ..... A63F 13/812
10,137,347 B2 * 11/2018 Thornton ..... A63B 53/0466
10,159,885 B2 * 12/2018 Thornton ..... A63B 53/0466
10,188,932 B1 * 1/2019 Fierbaugh ..... G07F 17/38
10,207,173 B2 * 2/2019 Pasternak ..... G06Q 20/36
D842,401 S * 3/2019 Mueller ..... A63B 69/0002 D21/713
10,220,285 B2 * 3/2019 Thornton ..... A63B 69/36
10,226,681 B2 * 3/2019 Thornton ..... A63B 24/0003
10,254,139 B2 * 4/2019 Martin ..... A63B 69/3632
10,265,602 B2 * 4/2019 Haas ..... A63B 71/0619

(56) References Cited

U.S. PATENT DOCUMENTS 10,315,085 B2 * 6/2019 Danis ..... A63F 13/428
10,328,327 B2 * 6/2019 Porter ..... A63B 71/0616
10,339,978 B2 * 7/2019 Bose ..... A63F 13/213
10,350,455 B2 * 7/2019 Bentley ..... A61B 5/6895
10,406,399 B2 * 9/2019 Bentley ..... A63B 24/0021
10,427,017 B2 * 10/2019 Syed ..... A63B 60/16
10,500,452 B2 * 12/2019 Wallans ..... G06F 1/1684
10,504,334 B2 * 12/2019 Arnone ..... G07F 17/3288
10,546,467 B1 * 1/2020 Luciano, Jr. ..... A63B 24/0021
10,561,930 B2 * 2/2020 Richards ..... A63F 13/67
10,569,157 B2 * 2/2020 Mruk ..... A63D 5/04
10,589,161 B2 * 3/2020 Blanc ..... A63B 69/36
10,607,349 B2 * 3/2020 Bose ..... A63F 13/812
10,617,926 B2 * 4/2020 Thornbrue ..... A63B 69/0002
10,682,562 B2 * 6/2020 Syed ..... A63B 71/0669
10,706,273 B2 * 7/2020 Bose ..... G16H 20/30
10,716,989 B2 * 7/2020 Thornbrue ..... G01C 21/16
10,748,581 B2 * 8/2020 Bose ..... G11B 27/031
10,786,728 B2 * 9/2020 Haas ..... A63F 13/211
10,798,044 B1 * 10/2020 Barker ..... H04L 51/08
10,874,930 B2 * 12/2020 Schwartz ..... A63B 71/023
10,881,908 B2 * 1/2021 Bentley ..... G01P 13/00
10,920,437 B2 * 2/2021 Crookham ..... A63C 19/08
10,987,570 B2 * 4/2021 Richards ..... G07F 17/3295
11,007,417 B2 * 5/2021 Vigneau ..... A63C 19/08
11,039,763 B2 * 6/2021 Ye ..... A61B 5/1118
11,077,343 B2 * 8/2021 Wallans ..... A63B 71/0619
11,083,953 B2 * 8/2021 Hermandorfer ..... G06T 11/60
11,123,630 B2 * 9/2021 Spremberg ..... A63C 19/08
11,130,063 B2 * 9/2021 Barr ..... A63F 13/211
11,202,951 B1 * 12/2021 Augustin ..... G06F 3/011
11,207,582 B2 * 12/2021 Lewis ..... A63B 69/0053
11,305,194 B2 * 4/2022 Schwartz ..... H04W 4/023
11,458,378 B2 * 10/2022 Strickland ..... A63B 71/0669
2002/0004723 A1 * 1/2002 Meifu ..... A63B 69/36 473/407
2002/0077165 A1 * 6/2002 Bansemer ..... G07F 17/38 463/7
2002/0107590 A1 * 8/2002 Liegey ..... A63F 3/081 700/91
2002/0155907 A1 * 10/2002 Bewley ..... A63B 69/40 473/451
2003/0008711 A1 * 1/2003 Corbo ..... G07F 17/3244 700/91
2003/0171144 A1 * 9/2003 Letovsky ..... G07F 17/3295 463/16
2004/0033833 A1 * 2/2004 Briggs ..... A63G 31/00 463/42
2004/0039461 A1 * 2/2004 Stefani ..... G07F 17/32 700/91
2004/0157684 A1 * 8/2004 Craven, Jr. ..... A63B 71/02 473/470
2004/0186600 A1 * 9/2004 Tumacder ..... G07F 17/3262 700/91
2005/0026664 A1 * 2/2005 Bansemer ..... A63F 9/0291 463/7
2005/0043829 A1 * 2/2005 Rossides ..... G07F 17/3255 700/91
2005/0055113 A1 * 3/2005 Gauselmann ..... G07F 17/32 700/91
2005/0071024 A1 * 3/2005 Henshaw ..... G07F 17/32 700/91
2005/0102047 A1 * 5/2005 Ottofy ..... G07F 17/3293 700/91
2005/0170886 A1 * 8/2005 Miller ..... G07F 17/3288 463/28
2005/0250590 A1 * 11/2005 Doaga ..... A63B 71/06 473/150
2005/0288803 A1 * 12/2005 Ropp ..... G07F 17/3276 700/91
2006/0030959 A1 * 2/2006 Duhamel ..... G07F 17/3276 700/91
2006/0030960 A1 * 2/2006 Duhamel ..... G07F 17/3276 700/92
2006/0064184 A1 * 3/2006 Ream ..... G07F 17/32 700/91
2006/0074504 A1 * 4/2006 Maul ..... G06Q 10/00 700/91
2006/0121982 A1 * 6/2006 Martin ..... G07F 17/38 463/25
2006/0136079 A1 * 6/2006 Stern ..... G07F 17/32 700/91
2006/0161276 A1 * 7/2006 Soltani ..... G07F 17/3279 700/91
2006/0189386 A1 * 8/2006 Rosenberg ..... A63F 13/235 463/37
2006/0229749 A1 * 10/2006 Ghosh ..... G06Q 30/0221 700/91
2006/0241795 A1 * 10/2006 Weingardt ..... G07F 17/32 700/91
2006/0252476 A1 * 11/2006 Bahou ..... A63F 13/12 463/4
2007/0021853 A1 * 1/2007 Ma ..... G07F 17/3288 700/91
2007/0129133 A1 * 6/2007 Bansemer ..... G07F 17/32 463/16
2007/0135950 A1 * 6/2007 Oliveras ..... A63F 13/00 700/91
2007/0265043 A1 * 11/2007 Wang ..... A63F 13/812 463/2
2008/0234021 A1 * 9/2008 Palmer ..... G07F 17/38 463/2
2009/0023495 A1 * 1/2009 Koustas ..... G07F 17/32 463/43
2009/0131173 A1 * 5/2009 Gurnsey ..... F41A 33/02 463/42
2009/0191929 A1 * 7/2009 Nicora ..... A63F 13/335 463/3
2009/0291782 A1 * 11/2009 Hinn ..... A63B 67/002 273/374
2010/0070056 A1 * 3/2010 Coronel ..... G07F 17/3286 700/91
2010/0106266 A1 * 4/2010 Mazurik ..... G07F 17/32 700/91
2010/0298958 A1 * 11/2010 Connelly ..... A63B 71/06 473/451
2011/0003653 A1 * 1/2011 Stemle ..... A63B 63/007 473/456
2011/0054645 A1 * 3/2011 Lewis-Smith ..... G07F 17/3262 700/91
2011/0251703 A1 * 10/2011 Nguyen ..... A63F 13/35 700/92
2012/0075697 A1 * 3/2012 Astill ..... G03B 21/58 359/461
2012/0083908 A1 * 4/2012 Carpenter ..... G07F 17/3211 700/91
2012/0083909 A1 * 4/2012 Carpenter ..... G07F 17/32 700/92
2012/0123566 A1 * 5/2012 Ross ..... G07F 17/3293 700/91
2012/0123571 A1 * 5/2012 Lange ..... G07F 17/329 700/93
2012/0179277 A1 * 7/2012 Lymberopoulos ..... A63B 71/0616 707/E17.014
2012/0319989 A1 * 12/2012 Argiro ..... A63F 13/428 345/173
2013/0006402 A1 * 1/2013 Carlberg ..... A63F 13/798 700/91
2013/0017911 A1 * 1/2013 Kessler ..... A63B 67/002 473/476
2013/0060361 A1 * 3/2013 Gabrail ..... G07F 17/32 700/91
2013/0084930 A1 * 4/2013 Chang ..... G07F 17/32 463/11
2013/0116809 A1 * 5/2013 Carpenter ..... G07F 17/3225 700/92

(56) References Cited

U.S. PATENT DOCUMENTS

2013/0144410 A1* 6/2013 Amaitis ..... G07F 17/3288 700/91
2013/0196726 A1* 8/2013 Chang ..... G07F 17/3295 463/25
2013/0245797 A1* 9/2013 Moore ..... A63F 13/5375 700/91
2013/0273986 A1* 10/2013 Arnone ..... G07F 17/3225 463/7
2013/0331968 A1* 12/2013 Newton ..... A63F 13/798 700/92
2014/0039653 A1* 2/2014 Olive ..... G07F 17/3244 700/92
2014/0081438 A1* 3/2014 Knutsson ..... A63F 13/822 700/92
2014/0228084 A1* 8/2014 Arnone ..... G07F 17/3288 463/3
2014/0335924 A1* 11/2014 Arnone ..... G07F 17/3227 463/7
2015/0014924 A1* 1/2015 Asistin, Jr. ..... G07F 17/3276 273/148 R
2015/0028541 A1* 1/2015 Murakami ..... G07F 17/3297 273/121 A
2015/0045098 A1* 2/2015 Lim ..... G07F 17/3295 463/3
2015/0088289 A1* 3/2015 Robbins ..... G07F 17/3244 700/91
2015/0141128 A1* 5/2015 Arnone ..... G07F 17/3225 463/25
2015/0265925 A1* 9/2015 Knapp ..... A63F 13/00 463/3
2015/0294535 A1* 10/2015 Hightower ..... G07F 17/38 463/7
2016/0074738 A1* 3/2016 Dokhanian ..... G06Q 30/0207 473/415
2016/0171839 A1* 6/2016 Arnone ..... G07F 17/3295 463/7
2016/0199736 A1* 7/2016 Knapp ..... A63F 13/812 463/42
2016/0220878 A1* 8/2016 Devathi ..... A63B 43/004
2016/0358425 A1* 12/2016 Luciano ..... G07F 17/326
2017/0007881 A1* 1/2017 Penttila ..... A63B 65/10
2017/0157484 A1* 6/2017 Altshuler ..... G09B 19/0038
2017/0206745 A1* 7/2017 Arnone ..... G07F 17/3288
2017/0213422 A1* 7/2017 Arnone ..... G07F 17/3286
2017/0236380 A1* 8/2017 Arnone ..... G07F 17/3244 463/7
2017/0296894 A1* 10/2017 Min ..... A63B 71/0622
2017/0304705 A1* 10/2017 Hermandorfer ... A63B 69/0002
2018/0040203 A1* 2/2018 Winters ..... G07F 17/3225
2018/0174402 A1* 6/2018 D'Avanzo ..... G07F 17/38
2019/0005774 A1* 1/2019 Arnone ..... G07F 17/3225
2019/0022519 A1* 1/2019 Richards ..... G07F 17/38
2020/0032534 A1* 1/2020 Crookham ..... E04H 3/14
2020/0179786 A1* 6/2020 Vigneau ..... A63B 71/022
2020/0230493 A1* 7/2020 Richards ..... G07F 17/38
2020/0246679 A1* 8/2020 Oliveira ..... E01C 13/08
2020/0302739 A1* 9/2020 Wesson ..... G07F 17/3295
2021/0131129 A1* 5/2021 Crookham ..... E04H 3/14
2021/0154553 A1* 5/2021 Erickson ..... A63B 69/3691
2021/0205684 A1* 7/2021 Matory, III ..... A63B 24/0021
2022/0127868 A1* 4/2022 Cho ..... A63C 19/08

* cited by examiner

130

| Entry Fee | Sport Challenge | Financial Prize |
|---|---|---|
| $10 | Hole in one | $2500 |
| $10 | Bowl three strikes | $250 |
| $10 | Kick 35 yard field goal | $500 |
| $10 | Hit target at home plate from center field | $500 |
| $10 | Make half-court basketball shot | $200 |

FIG. 2

130a

| SOCCER SPORT CHALLENGES | | |
|---|---|---|
| Entry Fee | Sport challenge | Financial Prize |
| $10 | Corner kick into goal | $40 |
| $10 | Hit target from goal kick – dropped ball | $200 |
| $10 | Hit target from goal kick – free kick | $100 |
| $10 | Score 3x penalty kicks – hit goal target | $200 |
| $10 | Hit moving target – 30 yards | $300 |

FIG. 3A

130b

| FOOTBALL SPORT CHALLENGES | | |
|---|---|---|
| Entry Fee | Sport challenge | Financial Prize |
| $10 | Kick field goal – 20 yards | $100 |
| $10 | Kick field goal – 35 yards | $500 |
| $10 | Kick field goal – 50 yards | $700 |
| $10 | Kick field goals – 20 yards, 25 yards, and 50 yards | $2500 |
| $10 | Throw 20 yards and hit target | $250 |
| $10 | Throw 30 yards and hit target | $350 |
| $10 | Kick field goal 35 yards and throw 20 yards and hit target | $1000 |

FIG. 3B

130c

| BASKETBALL SPORT CHALLENGES | | |
|---|---|---|
| Entry Fee | Sport challenge | Financial Prize |
| $10 | Make 2x free throws | $25 |
| $10 | Make 3 point shot – top of key | $40 |
| $10 | Make 3 point shot from corner (player select) | $50 |
| $10 | Make 2x 3 point shots (player select) | $200 |
| $10 | Make half-court shot | $200 |
| $10 | Make half-court shot (bank) | $250 |
| $10 | Make half-court shot (swish) | $350 |

FIG. 3C

130d

| BASEBALL SPORT CHALLENGES | | |
|---|---|---|
| Entry Fee | Sport challenge | Financial Prize |
| $10 | Hit target at home from center field | $500 |
| $10 | Hit target at second base from home | $50 |
| $10 | Catch fly ball | $40 |
| $10 | Field infield groundball and hit target at first base | $100 |
| $10 | Throw strike – 60 mph+ | $100 |
| $10 | Hit homerun | $250 |
| $10 | Catch fly ball and hit target at home from centerfield | $600 |

FIG. 3D

130e

| BOWLING SPORT CHALLENGES | | |
|---|---|---|
| Entry Fee | Sport challenge | Financial Prize |
| $10 | Bowl strike | $50 |
| $10 | Bowl spare | $25 |
| $10 | Bowl two strikes | $150 |
| $10 | Bowl three strikes | $250 |
| $10 | Pick up 7-10 split | $2500 |

FIG. 3E

130f

| SHOOTING SPORT CHALLENGES | | |
|---|---|---|
| Entry Fee | Sport challenge | Financial Prize |
| $10 | Bullseye - 10 yards | $50 |
| $10 | Bullseye – 20 yards | $100 |
| $10 | Bullseye – 30 yards | $200 |
| $10 | Bullseye – 40 yards | $300 |
| $10 | Bullseye – 50 yards | $500 |
| $10 | Moving Target – 25 yards | $250 |
| $10 | Moving Target – 50 yards | $800 |

FIG. 3F

MULTI-SPORT CHALLENGE SYSTEMS AND METHODS

TECHNOLOGY FIELD

The present disclosure is directed to multi-sport challenge systems and methods, more specifically multi-sport challenge systems and methods that combine multi-sport challenges with that include participant wagering.

BACKGROUND

Sports offer enjoyment to participants as well as spectators and act to feed the innate competitive spirit. While the particular games and the athletic feats involved have changed, sport competitions have been a part of the human experience since recorded history. Indeed, early sports were found on every inhabited continent from the Mesoamerican ballgame in North America, boxing and archery in Africa, wrestling in Europe, to Cuju in China. Sports have been used as a learning tool for survival, physical development, coordination, team building, as well as for enjoyment and an outlet to escape our everyday lives.

Modern humans typically engage in sport during youth and then slowly reduce frequency of participation as they get older and the responsibility and physical decline of adulthood take hold. Commonly, adults seek their competitive sporting outlet as spectators of sport competitions participated in by others, such as younger individuals or those few adults who successfully overcame the odds to become professional athletes. Sometimes this outlet also manifests itself in participation in wagering on the outcomes or related components of the various sport competitions participated in by others. However, many adults still have a desire to compete and evidence their athletic skill in one or more sporting feats. Such adults may participate in recreational sports in their free time in order to hone their skills, but without pay and typically without accolades. What is needed are additional athletic outlets that allow adults to evidence their athletic skills without the barriers of being signed by a professional sport team.

SUMMARY

In one aspect, a multi-sport challenge system may include a multi-sport facility, a sport challenge menu including a plurality of selectable sport challenges, and a fee/prize subsystem. The multi-sport facility may include a plurality of sport grounds, wherein each of the sport grounds includes a full, partial, or simulated sport grounds. The sport challenge menu may include an entry fee and financial prize corresponding to each selectable sport challenge of the menu, wherein the entry fee is to be paid by a participant that selects the corresponding sport challenge for an opportunity to attempt the sport challenge. The financial prize may be awarded to the participant if the attempt successfully completes the sport challenge. The fee/prize subsystem may be configured to receive sport challenge selections made by participants and to collect the corresponding entry fees from the participants and output corresponding financial prizes upon successful completion of the selected sport challenges.

In one example, the multi-sport facility includes one or more bowling lanes, par 3 golf hole, and a full or reduced size basketball court, football field, and baseball field. In a further example, the multi-sport facility further includes one or more sport simulators. The one or more sport simulators include a golf simulator, shooting range simulator, a soccer simulator, a baseball simulator, or combination thereof.

BRIEF DESCRIPTION OF THE DRAWINGS

The novel features of the described embodiments are set forth with particularity in the appended claims. The described embodiments, however, both as to organization and manner of operation, may be best understood by reference to the following description, taken in conjunction with the accompanying drawings in which:

FIG. 2 is a menu listing various sport challenges of an exemplary multi-sport challenge system according to various embodiments described herein; and FIGS. 3A-3F show exemplary sport specific menus of a multi-sport challenge system according to various embodiments described herein.

DESCRIPTION

Figure 1:
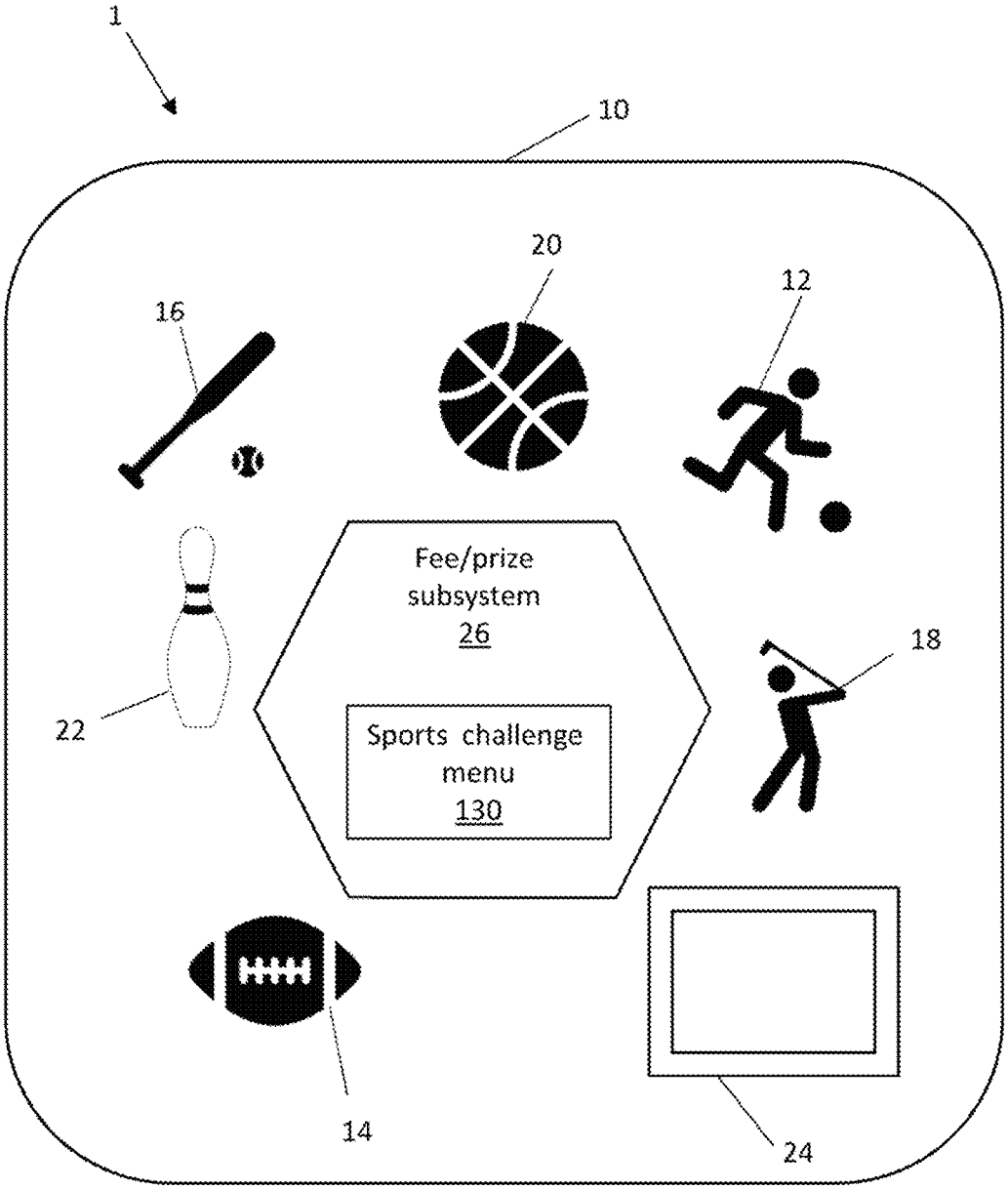
FIG. 1 schematically illustrates an exemplary multi-sport facility of a multi-sport challenge system according to various embodiments described herein.

The present disclosure describes a multi-sport challenge system and methods of conducting multi-sport challenges. FIGS. 1-3F illustrate features of various embodiments of the multi-sport challenge system wherein like numbers reference like features.

With reference to FIG. 1, the multi-sport challenge system 1 may include a multi-sport facility 10 housing a plurality of sport grounds or portions thereof whereon participants may attempt various sport challenges. The sport grounds may include one or more fields such as a soccer field 12, football field 14, or baseball field 16, golf hole 18, one or more courts such as a basketball court 20, tennis court, or jai alai court, hockey rink, bowling lane 22, gym/weights, track, or the like. In one example, the facility may include a multi-sport complex including multiple sporting grounds selected from a bowling lane 22, a golf hole 20, e.g., a par 3 golf hole, basketball court 16, football field 14, baseball field 18, shooting range, and soccer field 12. Additional and/or alternate sport grounds may also be included.

In one embodiment, one or more of the sport grounds may be reduced in size. For example, the multi-sport facility 10 may include a reduced size soccer field 12 (e.g., goal, quarter field, half field), a reduced size football field 14 (e.g., goalposts/uprights and 20 to 50 or more yards of field), a reduced size baseball field 16 (e.g., an infield, an outfield, an infield and partial outfield, an outfield and partial infield, a pitcher's mound and home plate, or a wedge section of the field taken from home plate), and/or a reduced size basketball court 20 (e.g., half court).

In some embodiments, the multi-sport facility 10 may include alternative sport grounds comprising one or more sport simulators 24 in addition to or instead of one or more of the traditional sport grounds such as a golf simulator, shooting range simulator, soccer simulator, or baseball simulator. Simulators 24 typically use various tracking technology such as infrared or camera detection to track movements of the user and/or sport implement, e.g., body part, ball, puck, bat, club, gun, etc. Simulators 24 may also include display screens in which users may interact with respect to the sporting environment being simulated. Example simulators 24 may include golf simulators including launch monitors and/or simulation programs manufactured by Foresight Golf, LLC, Boerne, Tex.; TruGolf, Inc., Centerville, Utah; TrackMan, Inc., Stamford, Conn.; SkyTrak, LLC, Winston Salem, N.C.; or Full Swing Golf Inc., San Diego, Calif. Example simulators 24 for additional sports may include simulators 24 such as TRUGOLF™ Multisport Simulator (baseball, hockey, soccer, footgolf), manufactured by TruGolf, Inc. or Full Swing MultiSport Simulators manufactured by Full Swing Golf Inc., San Diego, Calif. (handgun or rifle shooting, baseball hitting or pitching, soccer kicking or goal shooting, football passing or kicking, basketball goal shooting, lacrosse goal shooting, hockey goal shooting, golf, among others).

In various embodiments, the multi-sport challenge system 1 includes the multi-sport facility 10 configured to provide a plurality of sport challenges with respect to the sport grounds available to participants in which an entry fee is paid for the opportunity to win a financial prize upon successful completion of one or more of the available sport challenges. For example, the multi-sport challenge system 1 may include 8 or more, such as greater than 10, greater than 12, greater than 15, greater than 20, or greater than 25 sport challenges that may be available to participants that all include an entry fee to win a financial prize comprising a specific dollar amount upon successful completion of an entered sport challenge. Such a multi-sport challenge system and facility may allow participants to pay entry fees for one or more selected challenges to win a pre-determined amount by successfully completing the sport challenge. An entry fee may provide the participant a single attempt to successfully complete a specified sport challenge to receive the financial prize. As described in more detail below, various embodiments may include enhancers that increase relative difficulty of the sport challenge, e.g., multiple successful attempts, greater distance or speed, smaller target, etc.

The multi-sport challenge system 1 may include a fee/prize subsystem 26 configured to receive entry fees for the various sport challenges and distribute financial prizes upon successful completion of sport challenges subject to the entry fee. In some embodiments, the fee/prize subsystem 26 may include a physical building or structure within the multi-sport facility 10 where participants may select sport challenges, pay entry fees, and receive financial prizes upon successful completion of sport challenges. As described in more detail below, in one embodiment, the fee/prize subsystem 26 may be partially or substantially automated. For example, the fee/prize subsystem 26 may include a processor and memory storing instructions executable by the processor for performing the operations of the fee/prize subsystem 26.

As introduced above, the multi-sport challenge system may incorporate various sport challenges. Participants may compete in the sport challenges at the multi-sport facility on full or modified sized fields, courts, grounds, etc. and/or simulators.

In various embodiments, the multi-sport challenge system includes soccer related sport challenges. Soccer related sport challenges may include scoring a penalty kick or corner kick goal against a goalie or hitting a target from a penalty line or corner; successfully blocking a shot on goal; performing a goal kick, e.g., an indirect free kick or dropped ball, and hitting a stationary or moving target, target area, or achieving a specified distance. Additional requirements of the soccer challenges or soccer challenge enhancers may include performing the challenge while applying a predetermined curvature on the ball, successful completion of a multiple or a specified soccer related sport challenge or multiple soccer related sport challenges, e.g., successful completion of a parlay of two or more of the sport challenges. The above or other soccer related sport challenges may be performed on a full or partial soccer field and/or utilizing a soccer simulator of the multi-sport facility.

In some embodiments, the multi-sport challenge system includes football related sport challenges. Football related sport challenges may include successfully kicking an extra point; kicking a field goal; passing a football and hitting a stationary or moving target or area; punting a football a specified distance and/or to a specified location; or catching a punt or kickoff Field goals, passing distances, or punting distances may include various distances such as 10 yards, 15 yards, 20 yards, 25 yards, 30 yards, 35 yards, 40 yards, 45 yards, 50 yards, or more. Additional requirements of the football related sport challenges or football related sport challenge enhancers may include successful completion of a multiple of a selected football related sports challenge, e.g., consecutively, or multiple football related sport challenges, e.g., successful completion of a parlay of two or more of the football related challenges. In one example, a football related sport challenge includes making multiple successful passing attempts or a specified number of successful throws to a target or target area. In one example, a football related sport challenge includes successfully kicking field goals from two or more distances or successfully hitting a target or target area in succession. The above or other football related sport challenges may be performed on a full or partial, e.g., 50 yard, football field and/or using a football simulator of the multi-sport facility.

In various embodiments, the multi-sport challenge system includes basketball related sport challenges. Basketball related sport challenges may include hitting one or more shots from one or more specified locations of a basketball court such as half-court, 3 point (e.g., top of the key, corner, or participant choice), or free throw. Additional requirements of the basketball related sport challenges or basketball related sport challenge enhancers may include hitting basketball shots in a specified manner, such as a swish, bank, no backboard, or successful completion of a multiple of a selected basketball related sport challenge or multiple basketball related sport challenges, e.g., successful completion of a parlay of two or more of the basketball related sport challenges. The above or other basketball related sport challenges may be performed on a full or partial, e.g., half-court, basketball court and/or using a basketball simulator of the multi-sport facility.

In some embodiment, the multi-sport challenge system includes baseball related sport challenges. Baseball related sport challenges may include participants utilizing a full or partial baseball field or simulator. Example baseball related sport challenges may include participants throwing a baseball from an outfield location, e.g., centerfield, and hitting a target at home plate; throwing out of a crouch from a home plate location and hitting a target at second base, throwing from an infield position and hitting a target at first base. In a further example, baseball related sport challenges may include or be enhanced to include fielding the ball before throwing at the target and/or hitting the target within a specified time from when the ball is mechanically or manually hit or thrown to the participant, e.g., from home plate or a pitcher's mound or hits the participant's mitt. Additional examples of baseball related sport challenges may include throwing a strike from a pitcher's mound or throwing a breaking ball having a predetermined distance or range of distance of break. The pitch may be required to be a strike, which may be an enhancer to increase the financial prize for successfully completing the challenge. Further examples, may include fielding a ground ball, catching a fly ball, hitting a grounder, popup, homerun, or line drive, or stealing a base or breaking for a base steal with enough time to beat a predetermined timed throw at a predetermined foot speed, or to a particular side of the field. In one configuration, a baseball related sport challenge or an enhancer to a hitting related sport challenge may require the participant to hit a baseball to a particular area of the field. In one example, baseball related sport challenges may include or be enhanced for successful completion of multiple baseball related sport challenges, e.g., successful completion of a parlay of two or more of the baseball related sport challenges. The above or other baseball related sport challenges may be performed on a full or partial baseball field and/or using a baseball simulator of the multi-sport facility.

In various embodiments, the multi-sport challenge system includes golf related sport challenges. Golf related sport challenges may include participants utilizing a golf hole, e.g., a par 3 hole, green, range, fairway, simulator, or the like. For example, participants may pay an entry fee for an opportunity to win a financial prize for landing a ball on a green; landing the ball on the green a particular distance from the hole; landing the ball on the green with a particular amount, direction, or range of roll; holing the ball. The multi-sport facility 10 may include a fairway or golf simulator wherein participants pay an entry fee for a sport challenge that includes achieving a 200, 250, 300, or 350 yard drive. In order for distance to be accepted, the ball may be required to land or ultimately come to rest in a fairway or other specified location, such as on a green area. In one example, location of rest may be available as an enhancer to increase the financial prize for successfully completing the sport challenge. Other golf related sport challenges may include accuracy or distance using other clubs such as irons, hybrids, or non-driving woods. In some examples, golf sport challenges may include imparting a draw or fade ball flight, which in some instances may be applied as an enhancer to a distance or accuracy based golf sport challenge. Additional requirements of golf related sport challenges or golf related sport challenge enhancers may include completion of a multiple of a specified challenge or multiple different golf related challenges, e.g., successful completion of a parlay of two or more of the golf related challenges. The above or other golf related sport challenges may be performed on a full or partial golf hole and/or using a golf simulator of the multi-sport facility.

In some embodiments, the multi-sport challenge system includes bowling related sport challenges. Example bowling related sport challenges may include achieving a number of strikes in a row, achieving a number of spares in a row, achieving a combination of strikes and/or spares in a row, achieving a specified combination or series of strikes and spares, achieving a particular pin combination knocked down or remaining, or successfully picking up a specified split, e.g., 7-10, 8-10, 3-7, 7-9, 4-6-7-10, 3-7-10, 3-10, 5-7, etc. Additional requirements of bowling related sport challenges or bowling related sport challenge enhancers may include performing the sport challenge while applying a specified curvature to the bowling ball or initiating the roll at a specified location or area of the lane, successful completion of a multiple of a selected bowling related sport challenge or multiple bowling related sport challenges, e.g., successful completion of a parlay of two or more of the bowling related challenges. The above or other bowling related sport challenges may be performed on a full or partial bowling lane and/or using a bowling simulator of the multi-sport facility.

In various embodiments, the multi-sport challenge system includes shooting related sport challenges. Example shooting related sport challenges may include striking a target with a projectile, e.g., bullet, dart, BB, pellet, paintball, or arrow, shot from a rifle, handgun, bow, or crossbow, for example. One or more targets may be set up. Targets may include traditional bullseye type targets or may include objects such as animal figures or locations identified on objects. Additional requirements of shooting related sport challenges or shooting related sport challenge enhancers may include time to aim and fire the projectile, successful completion of multiple hits to a target or multiple targets or locations within a target. Shooting related sport challenges or enhancers may include distances from the target the participant must shot from and/or target motion. The above or other shooting related sport challenges may be performed on a full or partial range and/or using a firing range or target simulator of the multi-sport facility.

Additionally, alternatively, or combination with one or more of the above, the multi-sport challenge system may include sport challenges related to other sports. For example, the other sport challenges may include volley relates sport challenges such as those related to volleyball, footvolley, sepak takraw, or tennis. For instance, sport challenges may require participants to successfully serve, return, or spike the ball to a target or area. Still other sport challenges may include one or more sport related challenges selected from hockey related sport challenges, e.g., hitting a target with a puck along ice while on skates; pool related sport challenges, e.g., hitting a specified pool shot, combo, breaking a rack while hitting a specified ball or combination of balls into one or more pockets; darts related sport challenges, e.g., hitting a specified location, bull, bullseye, or combination of locations on a dart board to achieve a specified numerical score; climbing related sport challenges, e.g., climbing a climbing wall withing a specified period of time; frisbee golf related sport challenges, e.g., hitting a hole-in-one; and card or cup stacking sports related challenges, e.g., stacking a specified stacking configuration one or more times within a specified period of time; Olympic sports such as track and field, e.g., jumping a specified distance or height, running a specified distance in a specified period of time, hurling a discus or javelin or putting a shot a specified distance.

As introduced above, the multi-sport challenge system may include multi-sport challenge wagering. Wagering may include participants wagering on their ability to successfully complete a sport challenge. In various embodiments, participants may pay an entry fee for an opportunity to perform one or more sport challenges for an opportunity to win a financial prize. With reference to FIG. 2, an example menu 130 of selectable sport challenges that may be available to participants of the multi-sport challenge system may include paying a $10 entry fee for the opportunity to make a hole in one with a $2,500 prize, to bowl three strikes in a row for a $250 prize, to kick a 35 yard field goal for a $500 prize, to throw from centerfield to home plate to hit a target for a $500 prize, or to make a half-court basketball shot for a $200 prize.

In the illustrated example, entry fees are shown as being uniform and the prize amounts varied. Additionally or alternatively, different entry fees may be paid for the opportunity to win a uniform amount from a plurality of different sport challenges. Additionally or alternatively, entry fees for the opportunity to attempt particular sport challenges may be the same or different and the financial prize for successful completion of the sport challenges may be the same or different.

The financial prize amount for successful completion of the sport challenge may be fixed prior to or at the time of entry fee payment. In one embodiment, the financial prize may be predetermined based on an entry fee amount. For example, a higher entry fee may be paid to increase the financial prize. In some embodiments, a participant may enter an enhanced sport challenge that changes the requirements for winning the sport challenge in way that increases difficulty or decreases probability of successfully completing the sport challenge to increase the financial prize associated with the sport challenge. Enhancers may be time related, such as an increase or decrease in time in which the sport challenge must be successfully completed. Enhancers may be distance related such as increase or decrease in a distance of an objective of the sport challenge, e.g., a target or target area, goal, basket, or other objective of a sport challenge. Enhancers may be motion related such that an objective of the sport challenge, such as a target, goal, or basket, is in motion during the attempt. Enhancers may be speed related such that a target, ball, or participant must obtain, remain below or above, or maintain a particular speed or range of speed as part of the sport challenge. Enhancers may be series related such that multiple objectives such as targets, goals, or baskets must be hit in series or within a number of attempts. Enhancers may also include a combination of multiple enhancers. Enhancers may increase financial prizes by a predetermined same or different amount as applied to one or more selectable sport challenges. In one example, each enhancer may be associated with a multiplier such as 1.1, 1.5, 2, 2.5, etc., that may be multiplied by a base financial prize associated with a sport challenge to which it applies.

In some embodiments, an entry fee may give a participant more than one attempt to successfully complete the sport challenge. In one configuration, multiple attempts may be available for an increased entry fee or may reduce the financial prize available after each failed attempt.

In one embodiment, a participant may pay an entry fee for an attempt at a same or multi-sport parlay. In one example, the participant may select the sport challenges included in the parlay. In another example, the participant may select a portion or none of the sport challenges included in the parlay. For instance, the participant may select one or more sports associated with available sport challenges from which the challenges will be assigned, e.g., randomly or according to a predetermined schedule. The predetermined schedule may be based on a difficulty rating, for example. In another example, the participant is assigned one or more sport challenges without the opportunity to select the particular challenge. Such assigned sport challenges may award larger financial prizes than those that the participant is able to select.

In some embodiments, entry fee and/or financial prize amounts for particular sport challenges may vary by age, sex, weight, height, or other characteristic of the participant. For example, entry fees may be higher or lower and/or financial prize amounts may be higher or lower for participants older than 30, 40, 50, 60, or 70. Similarly, objectives of particular sport challenges may be varied based on one or more characteristics of the participant. For example, a participant under five feet tall or 50 years old may receive a $1000 prize for throwing to home plate from centerfield and hitting a target while those younger than 50 years old and five feet tall or more may have the opportunity to receive $500 for the same sport challenge.

With reference again to FIG. 1 together with FIGS. 3A-3F, the fee/prize subsystem 26 may generate, output, or otherwise provide a sport challenge menu 130 listing sport challenges and associated entry fees and financial prizes that participants may select. FIG. 3A illustrates an example soccer sport challenge menu 130*a* including plurality of soccer related sport challenges including associated entry fees and financial prizes. FIG. 3B illustrates an example football sport challenge menu 130*b* including plurality of football related sport challenges including associated entry fees and financial prizes. FIG. 3C illustrates an example basketball sport challenge menu 130*c* including plurality of basketball related sport challenges including associated entry fees and financial prizes. FIG. 3D illustrates an example baseball sport challenge menu 130*d* including plurality of baseball related sport challenges including associated entry fees and financial prizes. FIG. 3E illustrates an example bowling sport challenge menu 130*e* including plurality of bowling related sport challenges including associated entry fees and financial prizes. FIG. 3E illustrates an example shooting sport challenge menu 130*f* including plurality of shooting related sport challenges including associated entry fees and financial prizes. The sport challenge menus 130*a*, 130*b*, 130*c*, 130*d*, 130*e*, 130*f* are provided for illustration purposes with respect to sports, associated sport challenges, entry fees, and financial prizes. It is to be appreciated that embodiments may include additional, fewer, as well as different sports, associated sport challenges, entry fees, and financial prizes.

Sport challenge menus 130*a*, 130*b*, 130*c*, 130*d*, 130*e*, 130*f* may be displayed as signage with respect to a fee/subsystem building or structure, provided as handout documents to participants, displayed as signage or posted at one or more kiosk stations around the multi-sport facility, displayed as signage or posted at various sport grounds or surrounding portions thereof, e.g., available sport challenges associated with a particular sport grounds may be displayed at or near the associated sport grounds, or may be accessible for display on user electronic devices, e.g., handheld device, tablet, smart phone, or the like.

In one example, the fee/prize subsystem may provide one or more sport challenge menus 130*a*, 130*b*, 130*c*, 130*d*, 130*e*, 130*f* in an interactive environment wherein prospective participants may interact with the sport challenge menus 130*a*, 130*b*, 130*c*, 130*d*, 130*e*, 130*f* to obtain more information regarding the listed sport challenges. For instance, sport challenge menus 130*a*, 130*b*, 130*c*, 130*d*, 130*e*, 130*f* may be displayed on an interactive screen, e.g., kiosk touch screen, or be displayed on a user device, e.g., a smart phone, via a website or app executed or accessed on the user device. If enhancers are available, the sport challenge menus 130*a*, 130*b*, 130*c*, 130*d*, 130*e*, 130*f* may similarly include a list of associated enhancers. In one example, a user may select a desired sport challenge from a sport challenge menu 130*a*, 130*b*, 130*c*, 130*d*, 130*e*, 130*f* via the fee/prize submodule, e.g., interacting with an interactive screen, application, website, or through verbal communication with on-site staff of the fee/prize subsystem.

The fee/prize subsystem may be configured to accept digital fund transfers and/or send digital fund transfers with respect to entry fees and/or financial prizes. The fee/prize subsystem may address or be addressed by user devices via near field, wired, and/or wireless communication networks. Funds may be digitally transferred between a sport challenge account and/or a third party account, such as a digital wallet, e.g., banking app account, GOOGLE WALLET™, GOOGLE PAY®, APPLE PAY®, ALIPAY®, VENMO®, ZELLE®, DWOLLA®, or PAYPAL®.

Further to the above, the fee/prize subsystem may directly or indirectly execute fund transfers with respect to entry fee and financial prize payments. Fund transfers may also be mediated by a third-party fund transfer service. The fee/prize subsystem may be configured to interact with user devices of participants to set up accounts, such as digital wallet accounts, receive payments, make payments, and/or select sport challenges. In one embodiment, participants may set up and fund accounts with the fee/prize subsystem to be used for entry fee payments and/or receiving financial prize fund transfers.

The multi-sport challenge system may include a sport challenge link configured to assist in operation of the multi-sport challenge system. The sport challenge link may include a sport challenge app and/or sport challenge website. The sport challenge link may be utilized to link participants, via user devices, with the fee/prize subsystem. For example, the sport challenge link may be used to link digital, e.g., mobile, payment methods or accounts from which fund transfers may be executed between participants and the fee/prize subsystem. Payment methods and/or accounts may include accounts specific to the fee/prize subsystem, such as a sport challenge account, and/or accounts associated with third-party providers, any of which may include digital wallets. Payment methods may include a digital wallet setup and handled directly with the fee/prize subsystem or a third-party digital wallet such as GOOGLE WALLET™, GOOGLE PAY®, APPLE PAY®, ALIPAY®, VENMO®, ZELLE®, DWOLLA®, or PAYPAL®. to which fund transfers to and/or from participants and the fee/prize subsystem may be mediated.

As introduced above, in some embodiments, participants may establish a sport challenge account with the fee/prize subsystem. Sport challenge accounts may be established, for example, using the sport challenge link, which may include a sport challenge app executed on a user device or via a sport challenge website configured to provide user devices a secure link to the sport challenge account. In one embodiment, a sport challenge account comprises a digital wallet configured for executing fund transfers between the fee/prize subsystem and one or more participant accounts. In some configurations, participants may link their sport challenge accounts to third party fund transfer services and/or digital wallet to transfer funds into and out of their sport challenge accounts. The fee/prize subsystem may address or be addressed by user devices via near field, wired, and/or wireless communication networks to initiate and/or complete fund transfers with sport challenge accounts.

In one embodiment of an operation of the multi-sport challenge system, a participant, using a user device such as a smart phone, smart watch, tablet, or computer, or an on-site user interface such as a kiosk, may view and select one or more sport challenges. If the participant has a sport challenge account linked to the user device or has identified a sport challenge account to the user interface, an entry fee may be withdrawn if indicated by the participant or setup for such autopayment in the user account. In one example, a user may pay cash or credit rather than withdraw the entry fee from their sport challenge account. In a further example, participants may freely choose to pay entry fees with cash or credit and receive financial prizes in cash, credit, or deposit into their sport challenge account. In another example, participants are provided a card or other digital identification technology, e.g., active or passive RFID, BLUETOOTH® low energy technology, IBEACON®, near field, etc., which may also be associated with a user device, that may be detected by a reader or scanner of the fee/prize subsystem to identify the participant. The participant may swipe or merely position their digital identification for proximity reading or scanning for identification to initiate entry fee payment from their sport challenge account. The sport challenge selection and entry fee payment may also link the participant and the sport challenge account for transfer of financial prize funds if the participant successfully completes the selected sport challenge.

In various embodiments, the fee/prize subsystem may also include a participant monitoring unit. The monitoring unit may be configured to monitor participants with respect to adherence to rules applicable to attempts for selected sport challenges. Additionally or alternatively, the monitoring unit may be configured to verify successful completion of attempted sport challenges and/or associate the successful completion of sport challenges to a participant. The monitoring unit may include detection devices such as readers, scanners, or cameras to track and/or identify participants. The detection devices may utilize any suitable identification technology such as digital identification technology, e.g., active or passive RFID, BLUETOOTH® low energy technology, IBEACON®, near field, or recognition technology, e.g., facial, IR, or other biological or physiological recognition technology. Upon verification of successful completion of the sport challenge and identification of the participant by the monitoring unit, the fee/prize subsystem may initiate a fund transfer to an account, e.g., sport challenge account, linked to the participant.

In some embodiments, multi-sport challenge facility staff may one or more of receive sport challenge selections, collect entry fee payments, assist in organizing and/or conducting sport challenge attempts, monitoring participant adherence to rules applicable to attempts for selected sport challenges, verifying successful completion of attempted sport challenges, identification of participants successfully completing attempted sport challenges, or payment of financial prizes.

Additionally or alternatively to providing individual sport challenges in a wagering application, in some embodiments the multi-sport facility may be configured for competing in recreational sport play, rental for group outings, and/or athletic training in specific or multiple disciplines, with or without wagering. For example, the multi-sport challenge system has been described above such that entry fees are placed with the fee/prize subsystem, whereby the multi-sport challenge facility or fee/prize subsystem operates as the house and financial prizes are paid out by the fee/prize subsystem upon successful completion of the sport challenge. However, in some embodiments, the multi-sport challenge system may include sport challenge competition wagering. In one example, two or more participants, which may include two participants or more groups of participants, may pay an entry fee to compete in one or more sport challenges where the participant or participant group having the superior performance is awarded a financial pricing comprising a portion of the combined entry fee. The entry fee will typically be higher than it would be where the fee/prize subsystem operates as the house to payout financial prizes.

In one configuration of the sport challenge competition, the sport challenge may include any sport challenge, such as those described herein, and the participant successfully completing the sport challenge where the other has failed is declared the winner and is awarded the financial prize. In one example, if no participant or participant group successfully completes the sport challenge within the allotted number of attempts, the sport challenge is over and no participant receives a financial prize. In another embodiment, if no participant or participant group successfully completes the sport challenge within the allotted number of attempts, the participants may repeat the same or a different sport challenges until one participant or participant group has successfully completed the repeated sport challenge were the other participants or participant groups have failed. In an above or another example, if multiple competing participants or participant groups successfully completes the sport challenge, those participants or participant groups may repeat the same or a different sport challenge until only one competing participant or participant group has continued to successfully complete the sport challenge to the failure of the remaining participants or participant groups. In a further example, repeated sport challenges increase the difficulty of the sport challenge, e.g., throwing, shooting, or kicking distances to successfully complete the sport challenge may be increased or target may be put in motion or target sizes may be decreased.

In an above or another configuration, sport challenges may be modified to competitive sport challenges such that a participant or participant group is awarded the financial prize for performing the sport challenge to a better degree than the other participants or participant groups, such as proximity to a target or distance may be used. For example, participants may compete in a golf related competitive sport challenge wherein the winner is determined as the closest to the hole or the longest drive. Still another competitive sport challenge may actively pit participants or participant groups against each other. For example, soccer penalty shots may be exchanged wherein the winner is the participant or participant group that scores more penalty goals on the other.

The present disclosure may include dedicated hardware implementations including, but not limited to, application specific integrated circuits, programmable logic arrays and other hardware devices can likewise be constructed to implement the methods described herein. Applications that may include the apparatus and systems of various embodiments broadly include a variety of electronic and computer systems. Some embodiments implement functions in two or more specific interconnected hardware modules or devices with related control and data signals communicated between and through the modules, or as portions of an application-specific integrated circuit. Thus, the example network or system is applicable to software, firmware, and hardware implementations.

In accordance with various embodiments of the present disclosure, the processes described herein may be intended for operation as software programs running on a computer processor. Furthermore, software implementations can include, but are not limited to, distributed processing or component/object distributed processing, parallel processing, or virtual machine processing that may be constructed to implement the methods described herein.

The present disclosure describes various systems, modules, units, devices, components, and the like. Such systems, modules, units, devices, components, and/or functionalities thereof may include one or more electronic processers, e.g., microprocessors, operable to execute instructions corresponding to the functionalities described herein. Such instructions may be stored on a computer readable medium. Such systems, modules, units, devices, components, the like may include functionally related hardware, instructions, firmware, or software. For example, modules or units thereof, which may include generators or engines, may include physical or logical grouping of functionally related applications, services, resources, assets, systems, programs, databases, or the like. The systems, modules, units, which may include data storage devices such as databases and/or pattern library may include hardware storing instructions configured to execute disclosed functionalities, which may be physically located in one or more physical locations. For example, systems, modules, units, or components or functionalities thereof may be distributed across one or more networks, systems, devices, or combination thereof. It will be appreciated that the various functionalities of these features may be modular, distributed, and/or integrated over one or more physical devices. It will be appreciated that such logical partitions may not correspond to physical partitions of the data. For example, all or portions of various systems, modules, units, or devices may reside or be distributed among one or more hardware locations.

The present disclosure contemplates a machine-readable medium containing instructions so that a device connected to the communications network, another network, or a combination thereof, can send or receive voice, video or data, and to communicate over the communications network, another network, or a combination thereof, using the instructions. The instructions may further be transmitted or received over the communications network, another network, or a combination thereof, via the network interface device. The term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that causes the machine to perform any one or more of the methodologies of the present disclosure. The terms "machine-readable medium," "machine-readable device," or "computer-readable device" shall accordingly be taken to include, but not be limited to: memory devices, solid-state memories such as a memory card or other package that houses one or more read-only (non-volatile) memories, random access memories, or other re-writable (volatile) memories; magneto-optical or optical medium such as a disk or tape; or other self-contained information archive or set of archives is considered a distribution medium equivalent to a tangible storage medium. The "machine-readable medium," "machine-readable device," or "computer-readable device" may be non-transitory, and, in certain embodiments, may not include a wave or signal per se. Accordingly, the disclosure is considered to include any one or more of a machine-readable medium or a distribution medium, as listed herein and including art-recognized equivalents and successor media, in which the software implementations herein are stored.

This specification has been written with reference to various non-limiting and non-exhaustive embodiments. However, it will be recognized by persons having ordinary skill in the art that various substitutions, modifications, or combinations of any of the disclosed embodiments (or portions thereof) may be made within the scope of this specification. Thus, it is contemplated and understood that this specification supports additional embodiments not expressly set forth in this specification. Such embodiments may be obtained, for example, by combining, modifying, or re-organizing any of the disclosed steps, components, elements, features, aspects, characteristics, limitations, and the like, of the various non-limiting and non-exhaustive embodiments described in this specification.

Various elements described herein have been described as alternatives or alternative combinations, e.g., in a lists of selectable sport challenges, entry fees, financial prizes, sport grounds, etc. It is to be appreciated that embodiments may include one, more, or all of any such elements. Thus, this description includes embodiments of all such elements independently and embodiments including such elements in all combinations.

The grammatical articles "one", "a", "an", and "the", as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an application of the described embodiments. Further, the use of a singular noun includes the plural, and the use of a plural noun includes the singular, unless the context of the usage requires otherwise. Additionally, the grammatical conjunctions "and" and "or" are used herein according to accepted usage. By way of example, "x and y" refers to "x" and "y". On the other hand, "x or y" corresponds to "x and/or y" and refers to "x", "y", or both "x" and "y", whereas "either x or y" refers to exclusivity.

What is claimed is:

1. A multi-sport challenge system, the system comprising:

a multi-sport facility including a plurality of sport grounds, wherein each of the sport grounds includes a full sports grounds, partial sports grounds, sports simulator grounds, or combination thereof;

a plurality of different sport challenges that a participant may select to attempt to perform through interaction with the sport grounds that corresponds to the selected sports challenge, each sports challenge having an associated entry fee to be paid by the participant for an opportunity to attempt the sports challenge and an associated financial prize to be awarded to the participant if the attempt by the participant successfully performs the sport challenge, wherein the sports grounds include at least four different types of sports grounds, each hosting at least one of the sport challenges, wherein the at least four different types of sports grounds and the corresponding at least one sport challenge hosted by the sports grounds are selected from the group consisting of a pitcher's mound and home plate that hosts a corresponding sport challenge comprising awarding the associated financial prize to the participant if the participant successfully throws a strike over the home plate from the pitcher's mound, a bowling lane that hosts a corresponding sports challenge comprising the participant bowling a bowling ball down the bowling lane and awarding the associated financial prize to the participant if the participant successfully achieves a specified number of strikes in a row, at least a partial basketball court including a basketball goal that hosts a corresponding sports challenge comprising the participant shooting a basketball from one or more specified locations on the at least partial basketball court and awarding the associated financial prize to the participant if the participant successfully shoots the basketball through a hoop of the basketball goal from the one or more specified locations, at least a partial baseball field including an outfield and home plate that hosts a corresponding sports challenge comprising the participant throwing a baseball from the outfield toward home plate and awarding the participant the associated financial prize if the participant successfully hits a target located near the home plate, a par 3 golf hole that hosts a corresponding sports challenge comprising the participant hitting a golf ball from a tee box of the par 3 golf hole and awarding the participant the associated financial prize if the participant successfully gets a hole-in-one, an American football uprights and at least a partial football field that hosts a corresponding sports challenge comprising the participant kicking a football from a specified distance on the football field and awarding the participant the associated financial prize if the participant successfully kicks the football through the uprights, and a soccer goal and at least a partial soccer field that hosts a corresponding sports challenge comprising the participant kicking a soccer ball and awarding the participant the associated financial prize if the participant successfully kicks the soccer ball into the soccer goal; and a fee/prize subsystem to receive sport challenge selections made by participants and to collect the corresponding entry fees from participants and output corresponding financial prizes upon successful performance of the selected sport challenges.

2. The multi-sport challenge system of claim 1, wherein the sports grounds include the bowling lane, the par 3 golf hole, the at least a portion of a basketball court including the basketball goal, the American football uprights and the at least a partial football field, and one or more sport simulators.

3. The multi-sport challenge system of claim 1, wherein the sports grounds include the par 3 golf hole, the at least a portion of a basketball court including the basketball goal, the American football uprights and the at least a partial football field, and the at least a partial baseball field including a home plate.

4. The multi-sport challenge system of claim 3, wherein the sports grounds further include one or more sport simulators.

5. The multi-sport challenge system of claim 4, wherein the one or more sport simulators include a golf simulator, shooting range simulator, a soccer simulator, a baseball simulator, or combination thereof.

6. The multi-sport challenge system of claim 5, wherein the one or more sport simulators include a golf simulator, shooting range simulator, a soccer simulator, and a baseball simulator.

7. The multi-sport challenge system of claim 5, wherein the sport simulators include a golf simulator corresponding to one or more sports challenges selected from hitting a golf ball and awarding the associated financial prize if the simulator determines that the participant successfully landed the ball on a simulated green or the participant hitting the golf ball and awarding the associated financial prize if the simulator determines that the participant successfully hit the ball a specified distance or greater.

8. The multi-sport challenge system of claim 1, wherein the sports grounds further include a full or partial tennis court or tennis simulator corresponding sports challenge comprising the participant serving a tennis ball and awarding the associated financial prize to the participant if the participant successfully serves the tennis ball to a target location.

9. A multi-sport challenge system, the system comprising:

a multi-sport facility including a plurality of different types of sport grounds, wherein each of the sport grounds includes a full sports grounds, partial sports grounds, sports simulator grounds, or combination thereof;

a plurality of different sport challenges that a participant may select to attempt to perform through interaction with the sport grounds that corresponds to the selected sports challenge, each sports challenge having an associated entry fee to be paid by the participant for an opportunity to attempt the sports challenge and an associated financial prize to be awarded to the participant if the attempt by the participant successfully performs the sport challenge, wherein the sports grounds and corresponding sports challenges comprise:

a bowling lane corresponding to a sports challenge comprising a participant successfully bowling a strike, a golf hole corresponding to a sports challenge comprising the participant successfully hitting a hole-in-one, a golf simulator corresponding to one or more sports challenges selected from the participant successfully landing a golf ball on a simulated green or the participant successfully hitting a drive a specified distance or greater as determined by the golf simulator, at least a partial basketball court including a basketball goal corresponding to one or more sports challenges selected from the participant successfully shooting a half-court shot through a hoop of the basketball goal with a basketball or the participant successfully shooting a consecutive number of free throws through a hoop of the basketball goal with a basketball, a full or partial baseball field corresponding to one or more sports challenges selected from the participant successfully hitting a target at home with a baseball thrown from an outfield location, the participant successfully throwing a baseball from a mound for a strike, or the participant successfully throwing a baseball from the mound for a strike at or above a specified velocity, American football uprights corresponding to a sports challenge comprising the participant successfully kicking one or more footballs through the uprights, and a soccer goal corresponding to a sports challenge comprising the participant successfully kicking a soccer ball into the goal; and a fee/prize subsystem to receive sport challenge selections made by participants and to collect the corresponding entry fees from participants and output corresponding financial prizes upon successful performance of the selected sport challenges.

10. The multi-sport challenge system of claim 9, wherein the golf simulator corresponds to the sports challenges comprising the participant successfully landing a golf ball on a simulated green or the participant successfully hitting a drive a specified distance or greater as determined by the golf simulator.

11. The multi-sport challenge system of claim 10, wherein the full or partial baseball field corresponds to the sports challenges comprising the participant successfully hitting a target at home with a baseball thrown from an outfield location, the participant successfully throwing a baseball from a mound for a strike, and the participant successfully throwing a baseball from the mound for a strike at or above a specified velocity.

12. The multi-sport challenge system of claim 10, wherein the at least a partial basketball court including the basketball goal corresponds to the sports challenge comprising the participant successfully shooting the half-court shot and the sports challenge comprising the participant successfully shooting the consecutive number of free throws.

13. The multi-sport challenge system of claim 9, wherein the sports grounds further include a full or partial tennis court or tennis simulator corresponding to a sports challenge comprising the participant successfully serving a tennis ball to a target location.

* * * * *